US009598922B1

(12) United States Patent
Beynon

(10) Patent No.: US 9,598,922 B1
(45) **Date of Patent: *Mar. 21, 2017**

(54) RETRIEVAL TOOL

(71) Applicant: Douglas T. Beynon, Spring, TX (US)

(72) Inventor: Douglas T. Beynon, Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/069,968

(22) Filed: Mar. 15, 2016

Related U.S. Application Data

(63) Continuation of application No. 13/815,248, filed on Feb. 13, 2013, now Pat. No. 9,284,807.

(51) Int. Cl.
*E21B 25/04* (2006.01)
*E21B 27/00* (2006.01)
*E21B 37/00* (2006.01)

(52) U.S. Cl.
CPC ..... *E21B 27/00* (2013.01); *E21B 25/04* (2013.01); *E21B 37/00* (2013.01)

(58) Field of Classification Search
CPC ..... E21B 31/00; E21B 27/00; E21B 31/16; E21B 49/00; E21B 49/02; E21B 25/00; E21B 25/06; E21B 25/04; E21B 10/02; E21B 37/00
See application file for complete search history.

(56) References Cited

U.S. PATENT DOCUMENTS 2,126,684 A * 8/1938 Humason ..... E21B 25/06 175/233
4,059,155 A * 11/1977 Greer ..... E21B 21/103 166/301
4,084,636 A 4/1978 Burge
4,296,822 A * 10/1981 Ormsby ..... E21B 10/48 175/237
4,545,432 A * 10/1985 Appleton ..... E21B 27/00 166/99
5,944,100 A 8/1999 Hipp
7,992,636 B2 8/2011 Telfer
2009/0126933 A1 5/2009 Telfer

OTHER PUBLICATIONS

*A.D.T. Hydraulic Junk Retriever*, Apple Drilling Tools Ltd. (undated).

* cited by examiner

*Primary Examiner* — Young-Suk (Philip) Ro
(74) *Attorney, Agent, or Firm* — Keith B. Willhelm

(57) ABSTRACT

A tool retrieves material from a well. The tool has a cylindrical tool body, malleable members, and a cylindrical jacket. The tool body defines a chamber adapted to receive material for retrieval. The malleable members are on the lower end of the tool body and preferably are made of a relatively hard, tough malleable material such as steel. They are bendable from an open position allowing material to enter the chamber to a closed position capturing the material. The jacket is mounted on the exterior of the tool body and has a mill surface which is adapted to bend the malleable members from the open position to the closed position. Relative axial movement of the jacket and the tool body causes the malleable members to bear on the mill surface and bend to the closed position.

22 Claims, 5 Drawing Sheets

RETRIEVAL TOOL

FIELD OF THE INVENTION

The present invention relates to tools used to retrieve material from oil and gas wells, and more particularly, to material retrieval tools adapted to envelope and capture material in a basket.

BACKGROUND OF THE INVENTION

Hydrocarbons, such as oil and gas, may be recovered from various types of subsurface geological formations. The formations typically consist of a porous layer, such as limestone and sands, overlaid by a nonporous layer. Hydrocarbons cannot rise through the nonporous layer, and thus, the porous layer forms a reservoir in which hydrocarbons are able to collect. A well is drilled through the earth until the hydrocarbon bearing formation is reached. Hydrocarbons then are able to flow from the porous formation into the well.

In what is perhaps the most basic form of rotary drilling methods, a drill bit is attached to a series of pipe sections referred to as a drill string. The drill string is suspended from a derrick and rotated by a motor in the derrick. A drilling fluid or "mud" pumped down the drill string, through the bit, and into the well bore. This fluid serves to lubricate the bit and carry cuttings from the drilling process back to the surface. As the drilling progresses downward, the drill string is extended by adding more pipe sections.

When the drill bit has reached the desired depth, larger diameter pipes, or casings, are placed in the well and cemented in place to prevent the sides of the borehole from caving in. Once the casing is cemented in place, it is perforated at the level of the oil bearing formation so hydrocarbons can enter the cased well. If necessary, various completion processes are performed to enhance the ultimate flow of hydrocarbons from the formation. The drill string is withdrawn and replaced with production tubing. Valves and other production equipment are installed in the well so that the hydrocarbons may flow in a controlled manner from the formation, into the cased well bore, and through the production tube up to the surface for storage or transport.

That simplified example of an oil and gas well, comprising as it does a single casing and a single tube, is not often encountered in the real world. Given the depth of most producing oil and gas wells and various environmental considerations, they more commonly incorporate a number of pipes or "tubulars" of varying diameters. Casings of diminishing diameter may be "telescoped" together to extend the depth of the well. There may be several production zones and multiple production strings, and it usually is necessary to run surveying and logging equipment into a well to assess the formation. In short, there are a wide variety of tools and operations that must be completed successfully in order to construct and operate a typical oil or gas well.

It is not surprising, therefore, that not all of the required operations are completed successfully. Accidents happen. Work strings break. Tools get jammed and must be drilled out. Things fall into wells. Such objects may have to be retrieved or "fished" out of a well before normal operations may be resumed, and doing so can create even more junk. Larger objects or "fish" may have to be ground or broken into smaller pieces so that they may be grabbed more easily. Explosives also may be used to break up a large fish. Even in the absence of such operations, however, cement lumps, rocks, congealed mud, metallic scale and shavings, and other debris may collect near the bottom of a well to a degree that it must be removed before production tubing may be installed.

The particular type of fishing tool employed depends in large part on the type of objects or "fish" to be retrieved from a well. So-called "junk baskets," such as those disclosed in U.S. Pat. No. 4,084,636 to E. Burge and U.S. Pat. No. 5,944,100 to J. Hipp, are adapted for retrieval of smaller pieces of junk and debris. Junk baskets typically rely on circulation of drilling fluid to sweep debris into a trap. The trap often includes hinged fingers which swing inwardly to allow debris to wash into the trap and then swing back out to close the trap. They also may incorporate teeth at the bottom of the tool for milling or grinding larger fish. While they can be effective in certain situations, such tools may be fairly complex, requiring as they typically do various channels, valves, and other fluid control mechanisms designed to create a flow of drilling fluid sufficiently powerful to sweep relatively dense debris upward into a trap.

So-called "washover" retrieval tools also have been designed to fish debris and smaller objects out of a well. Examples of such tools are disclosed in U.S. Pat. No. 4,545,432 to R. Appleton and U.S. Pat. No. 7,992,636 to G. Telfer. While there are certain differences, those tools share a common basic design. The generally cylindrical main housing of the tool defines a chamber, the lower end of which is open. Cutting teeth may be provided around the lower periphery of the open end of the housing. The tool housing also defines an annular space between inner and outer walls of the housing. That annular space essentially serves as a hydraulic cylinder in which is mounted an annular piston. The annular piston has malleable fingers at its lower end which are closed to entrap debris in the chamber.

More specifically, the tools are operated first by rotating the tool to drill through and under debris, for example, debris that has collected in the bottom of a well. That typically is done using reverse fluid circulation to encourage debris to flow into the chamber. Once drilling is complete, fluid is pumped down a work string into the tool and into the annular cylinder to actuate the piston. As the piston travels downward, the fingers at its lower end impinge on a mill surface provided on the lower end of the tool housing. Continued downward travel of the piston deforms and shapes the fingers into a basket, closing off the bottom of the chamber and preventing debris collected therein from falling out as to tool is pulled from the well.

While not without certain advantages, washover tools of this type can be problematic. The tool frequently is operated with reverse fluid circulation, that is, while fluid is drawn into the tool instead of being pumped out of the tool. Reverse circulation is intended to sweep cuttings and other debris into the tool, but that debris can interfere with actuation of the piston. If debris lodges on a valve seat, for example, it may not be possible to build up sufficient pressure to actuate the piston. Moreover, the tools rely on a shear disc, blowable valve seat, or other pressure limiting device to signal when the piston has fully stroked and the basket has been completely closed. If the piston hangs up in the cylinder, however, pressure may build to the point that the pressure limiting device is actuated before the basket has closed. Once that happens, there is no mechanism for completing the piston's stroke and closing the basket.

The annular cylinder also may be susceptible to damage, comprising as it does the external wall of the tool housing, especially if the tool is used to drill under debris. Any damage to the cylinder may increase the likelihood that the piston will hang up during operation. Providing a sufficiently rugged annular cylinder in the housing wall, other factors being equal, also necessarily diminishes the "swallow" diameter of the tool, that is, the diameter of the opening and chamber which accommodates a fish or other debris.

Such washover tools also are somewhat limited in their ability to handle large fish that may not be completely swallowed by the tool. They also may encounter problems if the tool has drilled into hard formation at the bottom of a well. The malleable fingers which are shaped into a basket during actuation of the tool typically are fabricated from a relatively soft metal such as aluminum. Thus, they are limited in their ability to cut or drive through any material that may be in their path as the tool is actuated. If metallic fish or other hard materials are present in the tool opening, it may not be possible to shape the malleable fingers into a basket, or the fingers may hang up on the partially enveloped fish. Both scenarios may make it more difficult or impossible to retrieve material from the well.

Accordingly, there remains a need for new and improved systems, apparatus and methods for retrieving junk and other debris in oil and gas wells. Such disadvantages and others inherent in the prior art are addressed by various aspects and embodiments of the subject invention.

SUMMARY OF THE INVENTION

The subject invention encompasses various embodiments and aspects, some of which are specifically described and illustrated herein, and other which are apparent from those embodiments specifically addressed. Such embodiments generally include tools and methods used to retrieve material from oil and gas wells, and more particularly, to material retrieval tools adapted to envelope and capture material in a basket.

For example, some aspects of the invention provides for a tool for retrieving material from a well which comprises a cylindrical tool body. The tool body is adapted for connection to a work string and for insertion into a well. It defines a chamber adapted to receive material to be retrieved from the well. The tool further comprises malleable members, a cylindrical jacket, and a mill surface.

The malleable members are provided on the lower end of the tool body and preferably are made of a relatively hard, tough malleable material such as steel. They are adapted to bend from an open position allowing ingress of the material into the chamber to a closed position restricting egress of the material from the chamber. The jacket is mounted on the exterior of the tool body over the lower end thereof and has an open end allowing ingress of the material into the chamber. The mill surface is provided on the jacket and is adapted to bend the malleable members from the open position to the closed position. The jacket and the tool body are operatively engaged for relative axial movement when the tool body is manipulated by the work string, that is, they can move up and down relative to each other along the length of the tool. The relative movement causes the malleable members to bear on the mill surface and bend from the open position to the closed position.

Other embodiments and aspects of the invention provide a retrieval tool which comprises a cylindrical tool body, malleable steel members, and a mill surface. The tool body is adapted for connection to a work string and for insertion into a well. It defines a chamber adapted to receive material to be retrieved from the well. The malleable steel members are adapted to bend from an open position allowing ingress of the material into the chamber to a closed position restricting egress of the material from the chamber. The mill surface is adapted to bend the malleable members from the open position to the closed position. The malleable members are operatively engaged for axial movement relative to the mill surface which causes the malleable members to bear on the mill surface and bend from the open position to the closed position.

The invention in other aspects and embodiments provides methods for retrieving material from a well which comprise running a retrieval tool into the well. The tool comprises a cylindrical tool body, malleable members, a cylindrical jacket, and a mill surface. The tool body defines a chamber having an open lower end and is adapted to receive material to be retrieved from the well. The malleable members are provided on the lower end of the tool body and are in an open position allowing ingress of the material into the chamber as the retrieval tool is run into the well. The cylindrical jacket is mounted on the exterior of the tool body over the lower end thereof. It has an open end allowing ingress of the material into the chamber and is operatively engaged for axial movement relative to the tool body. The mill surface is provided on the jacket and is adapted to bend the malleable members from the open position to a closed position restricting egress of the material from the chamber.

The tool then is worked to envelope the material in the chamber, and weight is released on the tool body to cause the tool body to move axially within the jacket. As the tool body moves axially the malleable members bear on the mill surface and bend from the open position to the closed position.

Yet other embodiments provide methods for cutting off and retrieving material from a well. The method comprises running a retrieval tool into the well where the tool comprises a cylindrical tool body, malleable steel cutting members, and a mill surface. The tool body defines a chamber having an open lower end and is adapted to receive material to be retrieved from the well. The malleable steel cutting members are in an open position allowing ingress of the material into the chamber as the retrieval tool is run into the well. The mill surface is adapted to bend the malleable steel cutting members from the open position to a closed position restricting egress of the material from the chamber. The malleable steel cutting members are operatively engaged for axial movement relative to the mill surface, and the axial movement causes the malleable steel cutting members to bear on the mill surface and bend from the open position to the closed position The tool then is worked to envelope the material in the chamber. When the material is in the chamber the tool is rotated and actuated. Actuation of the tool causes the malleable steel cutting members to bear on the mill surface and bend from the open position to the closed position. As the malleable steel cutting members close they cut through any material present in the open end of the chamber.

Still other embodiments and aspects of the novel tools and methods comprise such tools where the jacket and the tool body are operatively engaged by a pin and a slot. The pin engages and travels through the slot when the tool body is manipulated by the work string. The slot may be provided on the jacket and the pin provided on the tool body, or vice versa. The slot may comprise a first stop in which weight from the tool body is transferred to the jacket and a second stop in which weight from the tool body is transferred to the jacket. The first and second stops are offset axially, that is they are higher and lower along the length of the tool, such that the malleable members are remote from the mill surface when weight is transferred from the tool body at the first stop and have been moved to their closed position when the weight is transferred from the tool body at the second stop.

Various aspects of the novel tools and methods also comprise tools where the tool body comprises a coupling sleeve which is operatively engage to the jacket and a basket which comprises the malleable members. In other embodiments the tools may comprise a jacket having cutting members on its lower end or may comprise a jacket having a coupling sleeve operatively engaged to the tool body and a mill shoe comprising the mill surface.

The invention also encompasses other tools and methods where the tool comprises a tool body having an extender sleeve defining at least in part the chamber or a jacket having an extender sleeve.

Other aspects of the invention provide methods where the tool is worked to envelope material in the tool body chamber by releasing weight the tool body or the tool has cutting members on the lower end of the tool jacket and is worked to envelope material in the tool body by releasing weight on and rotating the tool body. After material is enveloped in the chamber, the tool body is pulled and rotated prior to again releasing weight on the tool body to close the malleable members.

Yet other embodiments provide methods wherein the tool is worked to envelope material in the chamber of the tool body by transferring weight from the tool body to the jacket at a first stop in the slot and the tool body is moved axially within the jacket to a second stop. The first and second stops are offset axially such that the malleable members are remote from the mill surface when the pin bears on the first stop and have been moved to their closed position when the pin bears on the second stop.

Thus, the present invention in its various aspects and embodiments comprises a combination of features and characteristics that are directed to overcoming various shortcomings of the prior art. The various features and characteristics summarized above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the manner in which it may be practiced. The subject invention encompasses other embodiments consistent with the claims set forth herein.

Figure 1A:
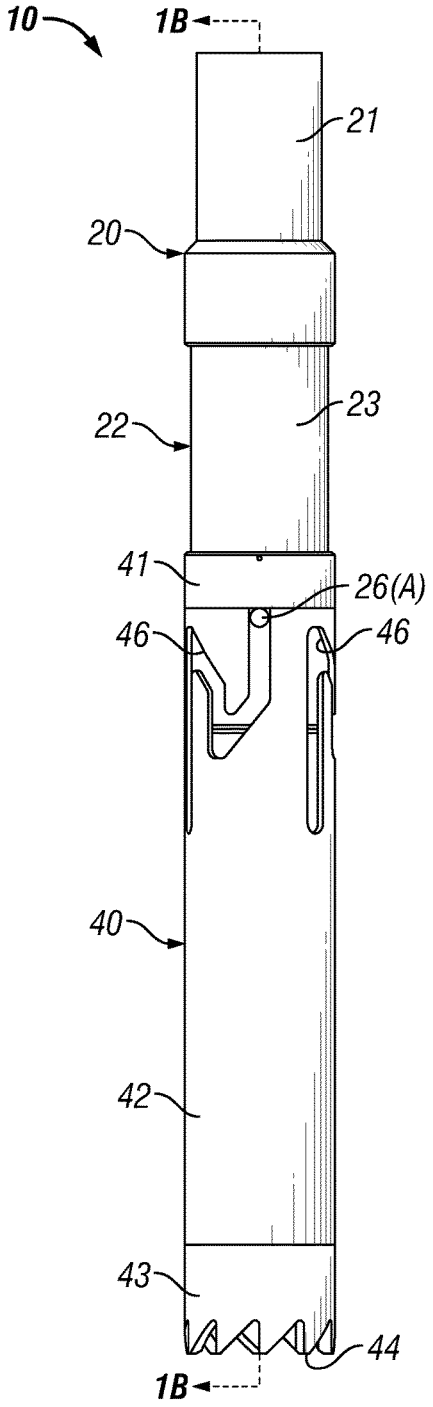
FIG. 1A is an elevation view of a preferred embodiment 10 of the junk retrievers of the subject invention showing junk retriever 10 in its run-in position.

In the drawings and description that follows, like parts are identified by the same reference numerals. The drawing figures are not necessarily to scale. Certain features of the invention may be shown exaggerated in scale or in somewhat schematic form and some details of conventional design and construction may not be shown in the interest of clarity and conciseness.

DESCRIPTION OF ILLUSTRATIVE EMBODIMENTS

The retrieval tools of the subject invention, such as the preferred embodiment 10 illustrated in FIGS. 1-5, are intended primarily to remove material, such as a core sample or junk and other debris in oil and gas wells. They comprise a cylindrical tool body that is adapted for connection to a work string and for insertion into a well. The tool body defines a chamber that is adapted to receive material in a well so that it may be retrieved from the well. Malleable members are provided on the lower end of the tool body. The malleable members are adapted to bend from an open position to a closed position. In the open position material is allowed to ingress into the chamber. In the closed position the malleable members restrict egress of material from the chamber. A cylindrical jacket is mounted on the exterior of the tool body over the lower end thereof. The jacket has an open end allowing ingress of the material into the chamber. A mill surface is provided on the jacket. The mill surface is adapted to bend the malleable members from the open position to the closed position. The jacket and the tool body are operatively engaged for relative axial movement when the tool body is manipulated by the work string. The relative movement between the jacket and tool body causes the malleable members to bear on the mill surface and bend from the open position to the closed position.

The tool body of the novel retrieval tools is adapted to provide an up-tool connection to a work string by which the tool may be manipulated by raising, lowering, or rotating the work string. It also provides a base onto which are mounted the various other tool components. For example, preferred retrieval tool 10 shown in FIGS. 1-5 comprises in general a tool body 20, a basket 30, and a jacket 40. Tool body 20 includes a mandrel 21 and a housing 22, and housing 22 in turn comprises a coupler sleeve 23 and an extender sleeve 24. Mandrel 21 has threads or other conventional connections at its upper end by which tool 10 may be engaged with a work string. Coupler sleeve 23 of housing 22 is connected to the lower end of mandrel 21, and extender sleeve 24 is connected to the lower end of coupler sleeve 23. Those connections also preferably are made up by threads or other releasable connections.

It will be noted that mandrel 21, coupler sleeve 23, and extender sleeve 24 are all generally cylindrical and define a central passageway through which drilling fluids may be circulated. As will be appreciated by those skilled in the art, circulation of drilling fluids either into or out of the tool will facilitate operation of the tool and retrieval of material from the well. Coupler sleeve 23 and extender sleeve 24 also define in large part a chamber 25. Chamber 25, as will be discussed further below, provides a space which can accommodate material, such as a core sample, a fish, or other objects, which is to be retrieved from a well.

The malleable members of the novel tools, as will be described and exemplified in further detail below, are composed and configured so that they can deform and thereafter retain material that has been captured in the chamber of the tool. For example, novel tool 10 comprises a basket 30 connected to the lower end of housing 22 and, more particularly, to the lower end of extender sleeve 24. Basket 30 has a plurality of somewhat elongated, generally triangular fingers 31 extending from the lower end of a generally open, cylindrical skirt 32. Basket 30 is composed of a malleable material so that fingers 31, when deformed as described further below, may form a more or less continuous basket.

Jacket 40 is generally cylindrical and mounted around the exterior of tool body 20 at its lower end and, more particularly, around housing 22. Jacket 40 generally comprises an end cap 41 which is treaded or otherwise secured to a coupler sleeve 42. A mill shoe 43 is threaded or otherwise secured to the other, lower end of coupler sleeve 42. The jacket preferably is provided with cutting teeth to allow the tool to drill through, around and below material to be retrieved. Thus, for example, mill shoe 43 includes a plurality of cutting teeth 44. Mill shoe 43 also is provided with a mill surface 45 upon which malleable fingers 30 are driven as will be described below.

It will noted that jacket 40 is mounted for relative reciprocating and rotational movement around housing 22. When assembled, however, relative movement between jacket 40 and housing 22, both linear and rotational, is restricted by tracking members, such as pins 26 which are provided on housing coupler sleeve 23 and tracks, such as slots 46 which are provided in jacket coupling sleeve 42. Tool 10 has three slots 46 and three pins 26, but a greater or smaller number may be provided if desired. Slots 46 preferably are spaced equidistantly around jacket coupling sleeve 43 and share a common predetermined shape or configuration. Pins 26 extend from coupler sleeve 23 into slots 46. Threaded cap 41 allows easy assembly of jacket 40 around housing 22 and thereafter retains pins 26 in slots 46. Thus, pins 26 are allowed to travel in slots 46, and thereby restrict and index the relative movement of jacket 40 and housing 22. That indexing, as now will be described in further detail, allows tool 10 to be manipulated to capture and retrieve material from a well.

Figure 1B:
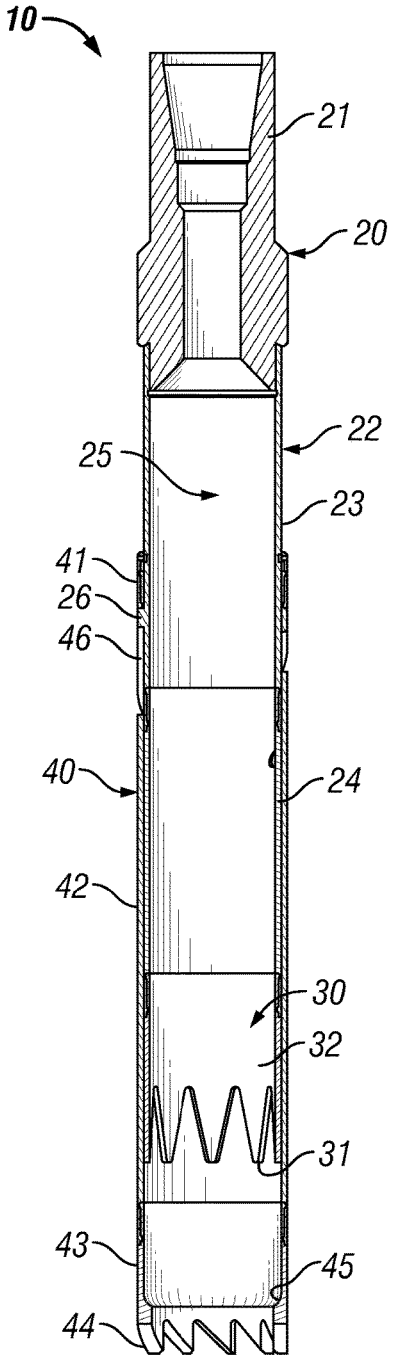
FIG. 1B is a cross-sectional view of junk retriever 10 in its run-in position shown in FIG. 1A.

As may be seen in FIG. 1 which show tool 10 in its run-in position, when tool 10 is installed on a work string and run into a well, jacket 40 will be in its extreme lower position relative to tool body 20. Pins 26 will be situated at the upper end of a first vertical section of slots 46. End cap 41 of jacket 40 bears on pins 26 such that pins 26 support and suspend jacket 40 around housing 22. End cap 41 thus may be viewed as defining first or run-in stops (corresponding to the location of pins 26 designated as 26(A)) in slots 46. Pins 26 and slots 46 prevent relative rotational movement between jacket 40 and housing 22 when, as is typical, the work string is rotated as tool 10 is run into a well. Jacket 40 preferably also is secured to housing 22 by, for example, shareable pins, screws, rings, wires, and the like (not shown) to prevent it from slipping upwards on housing 22 as tool 10 is run in. Alternately, slots 26 may be extended horizontally at the upper ends to provide vertical, as well as rotational locks if desired. In any event, mill shoe 43 hangs well below malleable fingers 31 on basket 30 when tool 10 is in its run-in position.

As tool 10 is run in and jacket 40 hits the bottom of a well, or encounters junk or other objects in a well, weight may be released onto tool 10 to shear any shear members holding jacket 40 in its run-in position. At that point, as will be appreciated from FIG. 2 which show tool 10 in its drilling position, tool body 20 is allowed to slide downward through jacket 40. As it does so, pins 26 will travel down the first vertical section and through a downwardly angled section, causing jacket 40 to rotate a few degrees clockwise relative to tool body 20. When pins 26 reach the bottom of the downwardly angled sections, what may be referred to as second or milling stops (corresponding to the location of pins 26 designated as 26(B)) in slots 46, pins 26 will support tool body 20 on jacket 40. Weight then may be released on tool 10 and that weight will be transferred to jacket 40.

Tool 10 then may be used to cut through or around and under junk in the well by rotating the work string in a clockwise direction. As tool 10 rotates in a clockwise direction, pins 26 transfer rotational force from tool body 20 to jacket 40. Teeth 44 on mill shoe 43 will bear on and mill away material in their path. Fingers 31 of basket 30 are well above mill surface 45 of mill shoe 43 and are still in their open position. Thus, as teeth 44 on mill shoe 45 mill away material in their path, tool 10 gradually will envelope and swallow junk and other material within the kerf of the cut. More specifically, as tool 10 bores further into the well junk or other material in its path passes through the opening at the lower end of tool 10 and will enter chamber 25 in housing 22. It will be appreciated, however, that tool 10 periodically may be lifted and lowered and rotated in either direction to work the tool as necessary to accomplish the boring and swallowing operation.

In any event, once boring is completed, the work string is raised, preferably with some clockwise rotation. Tool body 20 will travel up through jacket 40 and pins 26 will travel up a second vertical section and an upwardly angled section of slots 46 to third stops (corresponding to the location of pins 26 designated as 26(C)), as may be seen in FIG. 3 which show tool 10 in its actuation position. Third stops are situated at the top of another vertical section of slots 46. Thus, once pins 26 have reached third stops, weight may be released on the work string causing tool body 20 to travel downward through jacket 40.

Figure 4A:
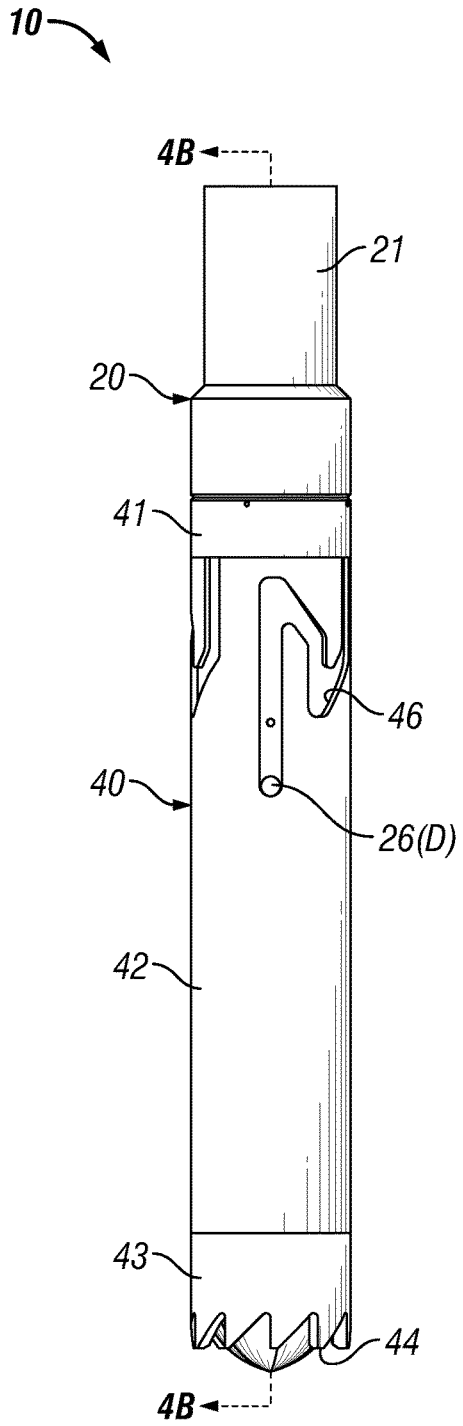
FIGS. 4A and 4B are, respectively, elevation and cross-sectional views of junk retriever 10 shown in FIGS. 1-3, wherein junk retriever 10 is shown in its capture position.
Figure 4B:
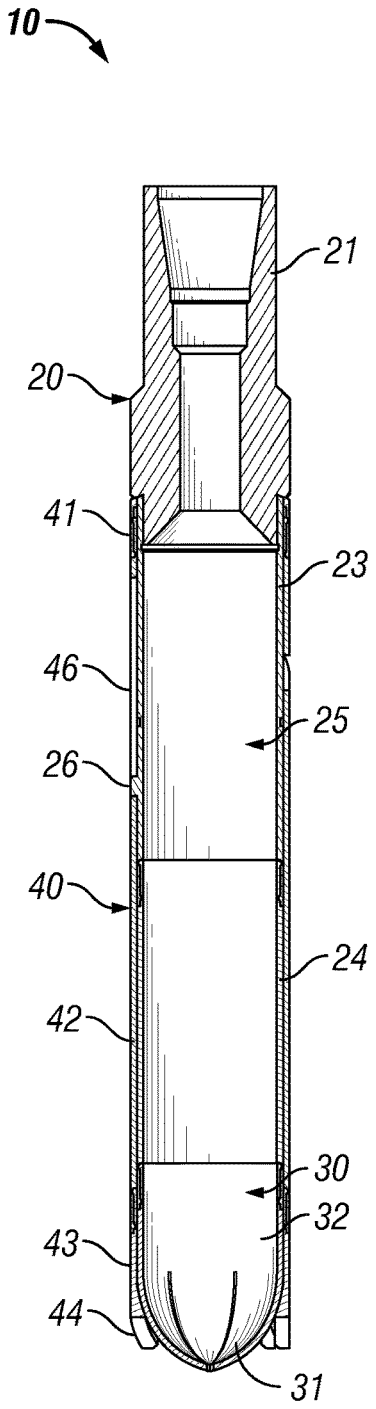
Figure 5A:
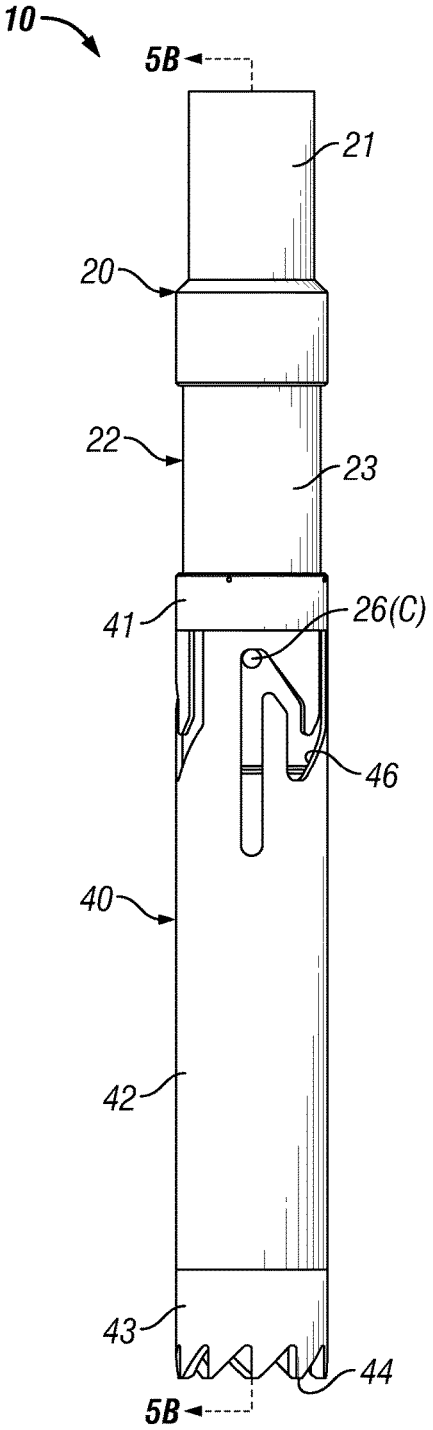
FIGS. 5A and 5B are, respectively, elevation and cross-sectional views of junk retriever 10 shown in FIGS. 1-4, wherein junk retriever 10 is shown in its run-out position.
Figure 5B:
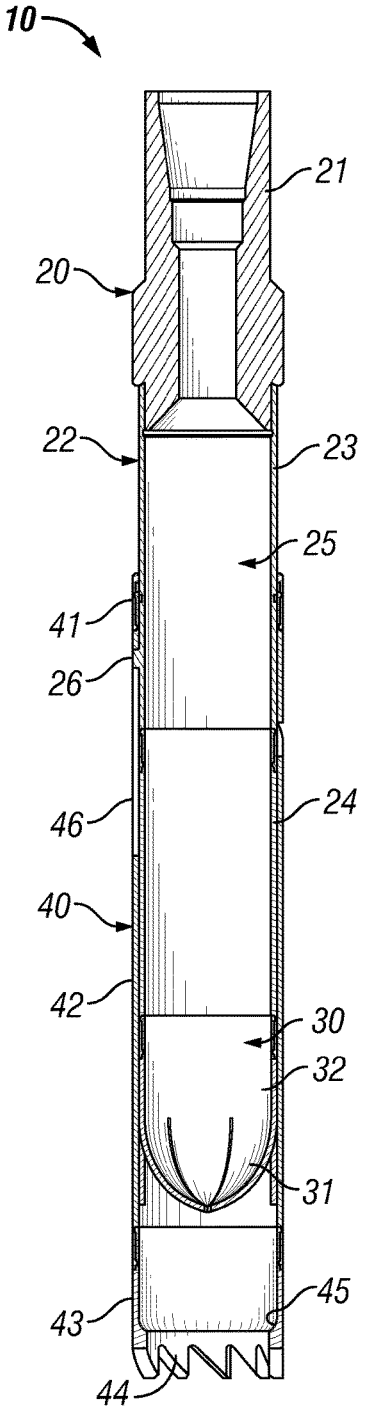

As will be appreciated from FIG. 4 which show tool 10 in its capture position, as tool body 20 slides down through jacket 40 fingers 31 of basket 30 will impinge upon mill surface 45 of mill shoe 43. Mill shoe 43 is fabricated from relatively hard metal, and mill surface 45 is configured such that it will urge fingers 31 from their open position to their closed position. At the same time, pins 26 travel down the third vertical section of slots 46 to fourth or capture stops (corresponding to the location of pins 26 designated as 26(D)). Capture stops, along with the abutment of cap 41 of jacket 40 and mandrel 21 of tool body 20, limit further downward travel of tool body 20 and the areas across which force is applied to fingers 31 on basket 30. Thus, when tool body 20 has moved completely down to capture stops, fingers 31 of basket 30 will be in their fully closed position in which they form a more or less closed basket and substantially shut off the bottom of tool housing 22. It will be appreciated that the edges of fingers 31 may be provided with various edges and bevels that may allow them to move more easily through displaceable or shareable material that may be present in the open end of jacket 40. As discussed in further detail below, they also may be configured and adapted to cut through formation, tubing, or other hard materials that are present.

Tool 10 and material captured within chamber 25 of housing 22 then may be retrieved from the well by pulling up the work string. Malleable fingers 31 having been formed into a basket will tend to prevent material from falling out of chamber 25. As will be appreciated from FIG. 5, which shows tool 10 in its run-out position, pins 26 will travel up the third vertical section of slots 46 as tool body 20 slides up through jacket 40. Thereafter, third stops will serve as run-out stops, supporting jacket 40 as tool 10 is pulled from the well.

It will be noted that slots preferably are configured to provide axially offset stops in which weight placed on the tool body will be transferred to the jacket, one of the stops allowing weight to be transferred to the jacket to facilitate drilling and the other to limit the stroke by which the malleable fingers are formed into a basket. The precise shape of the slots in various embodiments of the invention may be varied somewhat to achieve whatever desired degree of relative linear and rotational movement as may be desired. Likewise, while pins 26 and slots 46 described above in reference to exemplary tool 10 provided reliable and effective indexing of the relative movement between tool body 10 and jacket 40, other indexing means may be provided in different embodiments of the subject invention. Instead of slots, grooves may be provided in the inner surface of the jacket. Slots or grooves also may be provided in the tool housing and pins provided on the jacket, if desired. The pins or other tracking members may have different configurations as well. Other means of indexing the relative movement of the housing and tool may be provided.

For example, two sets of mating, but rotationally offset castellations may be provided on the tool body, for example, around the lower shoulder of mandrel 21 and the jacket, for example, the upper portion of jacket cap 41. A first set of castellations may be provided to engage and limit relative translational movement at a point where the fingers of a basket are removed from the mill surface of the jacket, and a second set (offset radially from the first set) may be provided to engage and terminate a stroke after the tool has been fully actuated and a basket formed.

It will be appreciated from the foregoing that the novel tools offer a number of advantages over conventional washover tools in which a basket is driven and shaped by a hydraulic piston. First of all, other factors being equal, the novel tools may be provided with a greater relative "swallow" diameter. That is, the main housing of conventional hydraulic washover tools defines an annular space between inner and outer walls. The inner and outer walls essentially serve as a hydraulic cylinder accommodating an annular piston. For a given outer diameter, the diameter of the chamber is necessarily diminished by the thickness of the double walls and piston. In contrast, the jacket of the novel tools is mounted on the exterior of the tool body, and there is no need to provide a double-walled tool body. The chamber within the tool body in which junk is captured, therefore, may have a greater diameter relative to a given external diameter of the tool.

The novel tools also may be more reliably operated as compared to washover tools in which a basket is driven and shaped by a hydraulic piston. The novel tools rely on mechanical force generated through the work string and mechanical stops to actuate and control the tool. Thus, for example, they lack hydraulic valves or seals which can fail in whole or in part because of debris swept into a tool as it is operated. The stroke of the novel tools also is controlled by mechanical stops, not rupture disks or other pressure release devices. In hydraulic washover tool, if a piston hangs up before its stroke is completed, rupture disks and the like may release hydraulic pressure prematurely, making it impossible to fully actuate the tool and form a basket under material to be retrieved. The amount of force that may be generated behind the novel tools also is much greater than the hydraulic forces typically driving conventional washover tools. Thus, the tool is less likely to hang up before a basket is completely formed.

More importantly, however, the ability to generate higher actuation forces means that the malleable members of the basket in various embodiments of novel tools may be made from materials which are harder and tougher than, and which may be shaped only with much greater force than required to shape materials traditionally used in conventional washover retrieval tools. For example, the basket and malleable members in hydraulically driven washover tools typically are fabricated from relatively soft, more easily shaped metals such as high tensile aluminum. Such materials may be formed readily into a basket using the relatively lower forces generated by conventional tools, but they are poorly suited to cut through any junk or material that may be situated in the open end of the tool as it is activated. Conversely, such conventional tools have not been able to generate the forces needed to shape harder, tougher materials.

That is not to say that aluminum and other softer, more easily shaped materials may not be used if desired in the novel tools. By using harder, tougher materials, however, other embodiments of the novel tools may be adapted to function as a coring tool. For example, basket 30 of tool 10 may be fabricated from steel, such as K-55, J-55, N-80, S-134, and 4140 grade steels which are much harder and tougher than conventional materials. Malleable fingers 31 also may be provided with cutting edges, provided with carbide or diamond cutting buttons or inserts, bronzed with crushed carbide, or otherwise adapted and configured to function as cutting teeth when they are rotated.

Figure 2A:
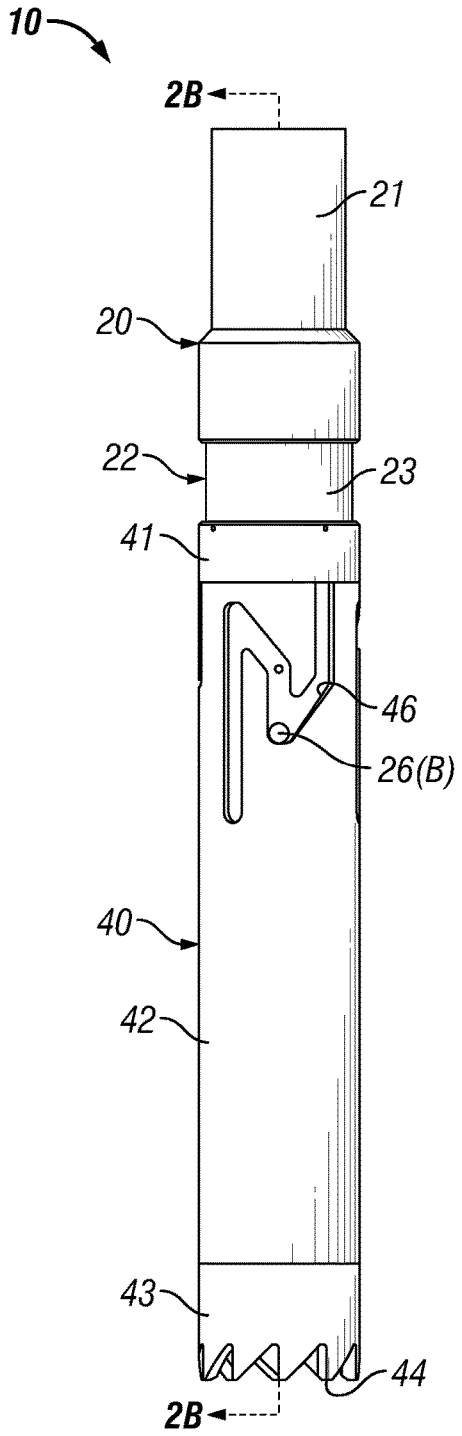
FIGS. 2A and 2B are, respectively, elevation and cross-sectional views of junk retriever 10 shown in FIG. 1, wherein junk retriever 10 is shown in its drilling position.
Figure 2B:
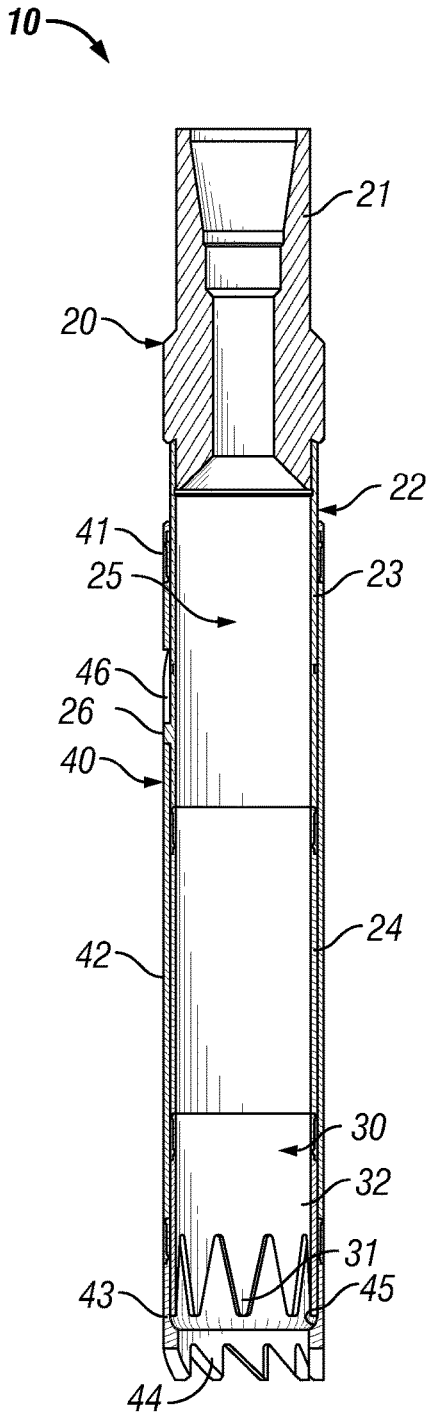
Figure 3A:
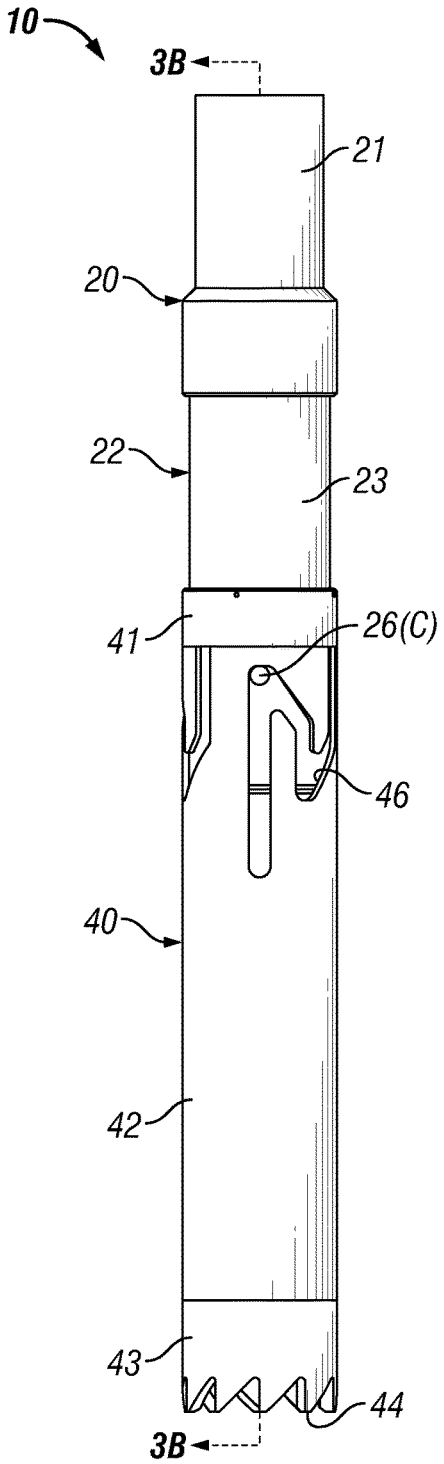
FIGS. 3A and 3B are, respectively, elevation and cross-sectional views of junk retriever 10 shown in FIGS. 1-2, wherein junk retriever 10 is shown in its actuation position.
Figure 3B:
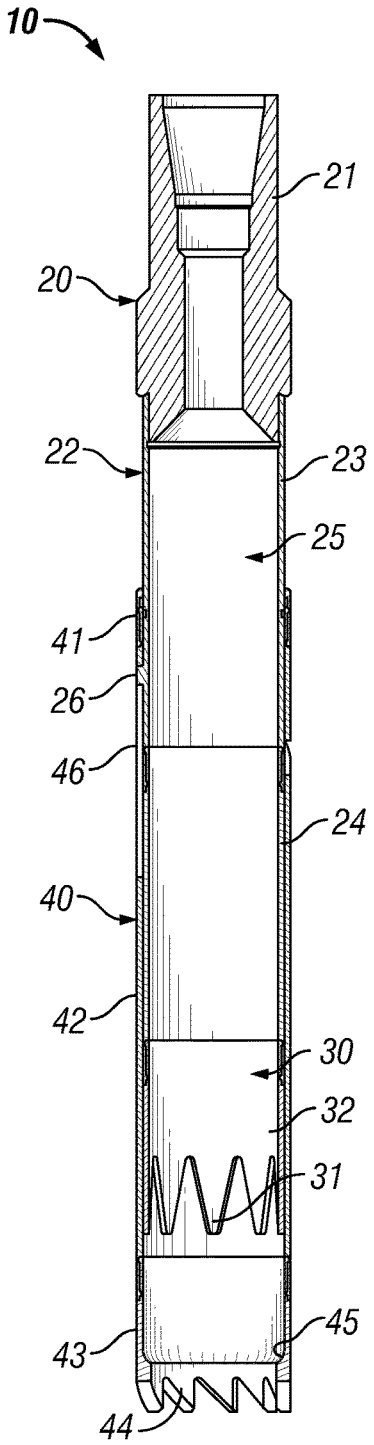

For example, tool 10 may be moved to its drilling position as shown in FIG. 2 and rotated until it has drilled through and swallowed a desired length of formation rock from the bottom of a well. Tool 10 then may be moved to its actuation position, as shown in FIG. 3. It will be appreciated that the core sample at this point is situated in chamber 25, but it is still connected to the formation. Thus, as tool 10 is actuated, it also will be rotated, allowing teeth 31 of basket 30 to cut through the core sample as they are shaped into a basket. As noted above, conventional hydraulically driven washover tools may not be adapted for such purpose because the basket must be made from relatively soft material such as aluminum which is incapable of efficiently cutting off a core sample under most circumstances. It also will be appreciated that the novel tools, in those embodiments using a malleable, but relatively hard basket may be used to cut off tubing or other metallic tools and objects in the well that may not be swallowed entirely by the tool.

Exemplified tool 10 has been disclosed and described as being assembled from a number of separate components. For example, tool body 20 and jacket 40 comprise a number of separate components. Workers in the art will appreciate that various of those components may be combined and fabricated as a single component if desired. By utilizing such separate components, however, the novel tools may be more easily fabricated and assembled. Utilizing separate components also provides the tool with greater adaptability and serviceability. For example, basket 30 of tool 10, since it is a separate component threaded or otherwise releasably connected to housing 22, may be replaced after junk is retrieved from a well and the tool 10 reused. Likewise, mill shoe 43 may be replaced if worn and tool 10 reused.

Moreover, by using extender sleeve 24 in housing 22, chamber 25 in which material is retrieved, may be made as long as desired simply by providing more or longer extender sleeves. Jacket 40 would be lengthened correspondingly, or an extender sleeve or sleeves provided therein. Otherwise, the basic construction and assembly of the tool would be unchanged. The novel tools, therefore, may be used to accommodate junk or core samples of relatively great length. For example, core samples typically are from 60 to 80 feet in length, but may be as long as 300 feet. Designing a hydraulically driven washover tools to accommodate such lengths is highly impractical, given the need to build hydraulic mechanisms into the tool.

As noted, the malleable members of the novel tools may be made of relatively soft malleable materials such as high tensile aluminum. In those embodiments where to novel tools will be used to retrieve core samples, the malleable members preferably are fabricated from malleable materials that are harder and tougher, such as steel. Otherwise, the retrieval tools of the subject invention may be made of materials and by methods commonly employed in the manufacture of oil well tools in general and retrieval tools in particular. Typically, the various components will be machined from relatively hard, high yield steel and other ferrous alloys by techniques commonly employed for tools of this type.

While this invention has been disclosed and discussed primarily in terms of specific embodiments thereof, it is not intended to be limited thereto. Other modifications and embodiments will be apparent to the worker in the art.

What is claimed is:

1. A tool for retrieving material from a well, said retrieval tool comprising:

(a) a cylindrical tool body adapted for connection to a work string and for insertion into a well, said tool body defining a chamber adapted to receive material to be retrieved from said well;

(b) said tool body having malleable members on the lower end of said tool body, said malleable members adapted to bend from an open position allowing ingress of said material into said chamber of said tool body to a closed position restricting egress of said material from said chamber;

(c) a cylindrical jacket mounted on the exterior of said tool body and extending beyond the lower end of said tool body, said jacket having an open end allowing ingress of said material into said chamber, (d) a mill surface provided on said jacket adapted to bend said malleable members from said open position to said closed position;

(e) said jacket and said tool body being operatively engaged for relative axial movement as said tool body is manipulated by said work string, said relative movement causing said malleable members to bear on said mill surface and bend from said open position to said closed position.

2. The retrieval tool of claim 1, wherein said jacket and said tool body are operatively engaged by a tracking member and a track, said tracking member engaging and traveling through said track as said tool body is manipulated by said work string.

3. The retrieval tool of claim 2, wherein said track is provided on said jacket and said tracking member is provided on said tool body.

4. The retrieval tool of claim 2, wherein said track comprises a first stop in which weight from said tool body is transferred to said jacket and a second stop in which weight from said tool body is transferred to said jacket, said first and second stops being offset axially such that said malleable members are remote from said mill surface as weight is transferred from said tool body at said first stop and said malleable members have been moved to said closed position as said weight is transferred from said tool body at said second stop.

5. The retrieval tool of claim 1, wherein said tool body comprises a coupling sleeve and a basket, said coupling sleeve being operatively engaged to said jacket and said basket comprising said malleable members.

6. The retrieval tool of claim 5 wherein said tool body comprises an extender sleeve defining at least in part said chamber.

7. The retrieval tool of claim 1, wherein said jacket comprises cutting members on the lower end of said jacket.

8. The retrieval tool of claim 1, wherein said jacket comprises a coupling sleeve and a mill shoe, said coupling sleeve being operatively engaged to said tool body and said mill shoe comprising said mill surface.

9. The retrieval tool of claim 8 wherein said jacket comprises an extender sleeve.

10. The retrieval tool of claim 1, wherein said jacket and said tool body are operatively engaged by rotationally offset sets of mating castellations, said sets of castellations being selectively engaged as said tool body is manipulated by said work string.

11. The retrieval tool of claim 1, wherein said jacket and said tool body are rotationally locked as said tool body moves axially within said jacket to cause said malleable members to bear on said mill surface and bend from said open position to said closed position.

12. A method for retrieving material from a well, said method comprising:

(a) running a retrieval tool into said well on a work string, said tool comprising:

i) a cylindrical tool body connected to said work string and defining a chamber having an open lower end and adapted to receive material to be retrieved from said well;

ii) said tool body having malleable members on the lower end of said tool body, said malleable members being in an open position allowing ingress of said material into said chamber;

iii) a cylindrical jacket mounted on the exterior of said tool body over the lower end thereof, said jacket having an open end allowing ingress of said material into said chamber and being operatively engaged for axial movement relative to said tool body; and iv) a mill surface provided on said jacket adapted to bend said malleable members from said open position to a closed position restricting egress of said material from said chamber;

(b) working said tool to envelope said material in said chamber; and (c) releasing weight from said work string on said tool body to cause said tool body to move axially within said jacket and said malleable members to bear on said mill surface and bend from said open position to said closed position.

13. The method of claim 12, wherein said tool body and said jacket are rotationally locked as the weight is released on said tool body in the step (c) and wherein the step (c) further comprises rotating said tool body as the weight is released on said tool body.

14. The method of claim of claim 12, wherein said jacket and said tool body are operatively engaged by a tracking member and a track, said tracking member engaging and traveling through said track as said tool body is manipulated.

15. The method of claim 14, wherein the step (b) of said method comprises transferring weight from said tool body to said jacket at a first stop in said slot as said tool is worked to envelope said material and the step (c) of said method comprises releasing weight on said tool body to cause said tool body to move axially within said jacket to a second stop; wherein said first and second stops are offset axially such that said malleable members are remote from said mill surface as said weight is transferred at said first stop and said malleable members have been moved to said closed position as said tool body has moved to said second stop.

16. The method of claim 12, wherein said tool body comprises a coupling sleeve and a basket, said coupling sleeve being operatively engaged to said jacket and said basket comprising said malleable members.

17. The method of claim 16, wherein said tool body comprises an extender sleeve defining at least in part said chamber.

18. The method of claim 12, wherein said jacket comprises a coupling sleeve and a mill shoe, said coupling sleeve being operatively engaged to said tool body and said mill shoe comprising said mill surface.

19. A method for retrieving material from a well, said method comprising:

(a) running a retrieval tool into said well, said tool comprising:

i) a cylindrical tool body defining a chamber having an open lower end and adapted to receive material to be retrieved from said well;

ii) malleable steel cutting members, said malleable steel cutting members being in an open position allowing ingress of said material into said chamber; and iii) a mill surface adapted to bend said malleable steel cutting members from said open position to a closed position restricting egress of said material from said chamber;

iv) wherein said malleable steel cutting members are operatively engaged for axial movement relative to said mill surface, said axial movement causing said malleable steel cutting members to bear on said mill surface and bend from said open position to said closed position;

(b) working said tool to envelope said material in said chamber;

(c) rotating said tool; and (d) actuating said tool as said tool is rotated to cause said malleable steel cutting members to rotate and bear on said mill surface and bend from said open position to said closed position and to cut through said material in said open end of said chamber.

20. The method of claim 19, wherein said material is a formation core sample.

21. The method of claim 19, wherein said malleable steel cutting members are operatively engaged for axial movement relative to said mill surface by a tracking member and a track, said tracking member engaging and traveling through said track as said tool is manipulated.

22. The method of claim 19, wherein said malleable steel cutting members and said mill surface are rotationally locked as said malleable steel cutting members are rotated in the step (d).

* * * * *